US005248109A

United States Patent [19]

Berger et al.

[11] Patent Number: 5,248,109

[45] Date of Patent: Sep. 28, 1993

[54] POSITIONING APPARATUS FOR COILS, MORE PARTICULARLY OF METAL STRIP, TO BE FITTED ON TO A REELING DRUM

[75] Inventors: Bernd Berger, Kaarst; Manfred Benfer, Iserlohn, both of Fed. Rep. of Germany

[73] Assignee: Sundwiger Eisenhutte Maschinenfabrik GmbH & Co., Hemer-Sundwig, Fed. Rep. of Germany

[21] Appl. No.: 785,319

[22] Filed: Oct. 30, 1991

[30] Foreign Application Priority Data

Nov. 27, 1990 [DE] Fed. Rep. of Germany ..... 4037671

[51] Int. Cl.[5] ..... B65H 19/10; B21C 47/00; B21C 51/00

[52] U.S. Cl. ..... 242/79; 242/78.6

[58] Field of Search ..... 242/79, 78.6, 78.8, 242/78, 58.6, 58, 57, 57.1

[56] References Cited

U.S. PATENT DOCUMENTS 3,490,628 1/1970 Adair .

FOREIGN PATENT DOCUMENTS 1266094 4/1968 Fed. Rep. of Germany ..... 242/79
1802211 6/1969 Fed. Rep. of Germany ..... 242/79
3822572 2/1990 Fed. Rep. of Germany .
18537 5/1974 Japan ..... 242/79
55-136511 10/1980 Japan .
136511 10/1980 Japan ..... 242/57.1
269933 11/1986 Japan ..... 242/79
187517 8/1987 Japan ..... 242/79
66017 3/1989 Japan ..... 242/79
317619 12/1989 Japan ..... 242/79
6016 1/1990 Japan ..... 242/79
1-51317 6/1990 Japan ..... 242/78.6
1-65813 6/1990 Japan ..... 242/79
WO8908598 9/1989 PCT Int'l Appl. .

*Primary Examiner*—Stanley N. Gilreath
*Attorney, Agent, or Firm*—Marmorek, Guttman & Rubenstein

[57] ABSTRACT

The invention relates to a positioning apparatus for coils, more particularly of metal strip, to be fitted on to a reeling drum. To determine on all sides the internal diameter of the coil 1 and its vertical and lateral position in relation to the reeling drum 2, the internal contour of the coil 1 is determined by a measuring head 13 which measures 360° and, in dependence on the measured values to be obtained, by comparison with the corresponding measured values for the reeling drum 2 adjusting members are acted upon for the vertical adjustment of a lifting carriage 3 for the coil 1 and/or the lateral offsetting and/or the relative rotation between the coil 1 and the reeling drum 2.

3 Claims, 5 Drawing Sheets

CONTROL
10a
I
II
r
0
90
180
270
360°

10
11
13
8
9
12
13a
1
3
h1
h4
b
hm hm 10
9
8
h1
h2
h3
h4
11
12
13
13a
13b
1
D r
0
0
90
180
270
360°

POSITIONING APPARATUS FOR COILS, MORE PARTICULARLY OF METAL STRIP, TO BE FITTED ON TO A REELING DRUM

BACKGROUND OF THE INVENTION

The invention relates to a positioning apparatus for coils, more particularly of metal strip, to be fitted on to a reeling drum, comprising a lifting carriage for the coil and a measuring device which determines the position of the internal diameter of the coil and whose measured values are evaluated by a control device for the vertical adjustment and movement of the lifting carriage in relation to the reeling drum.

To enable a coil borne by a lifting carriage to be fitted on to a reeling drum, the coil must be removed by the lifting carriage into a vertical position in which the position of the internal diameter of the coil corresponds with that of the reeling drum. To automate this operation it is known to obtain the vertical position of the internal diameter of the coil either directly by means of a sensing element determining the internal diameter at the top and bottom vertex, or indirectly via the external diameter of the coil, by determining the top vertex. The control device for the lifting carriage is then acted upon in dependence on this measuring result. However, experience shows that the operation of the lifting carriage in dependence on said measured values is not enough to ensure the positioning of the coil without colliding with the reeling drum. A cause of such a collision may be that the internal diameter lies eccentrically in relation to the external diameter when the position of the internal diameter is indirectly determined via the external diameter. When the internal diameter is directly determined at diametrically opposite points, collisions may occur because the internal diameter is deformed oval and/or the innermost turn with the start of the coil extends laterally inwards and/or the internal diameter is eccentrically offset laterally. Another fault in the winding of the coil may be that the start (tongue) of the strip is not introduced into the recess provided therefor on the reel. The result is that when the reeling drum expands, the coil is disposed eccentrically on the drum, something which may lead to fluctuations in the pull on the strip when the coil runs off the reeling drum.

It is an object of the invention to provide a positioning apparatus for coils to be fitted on to a reeling drum which ensures that the coils are fitted on to the reeling drum in a trouble-free manner.

SUMMARY OF THE INVENTION

This problem is solved by the features that the measuring device which measures 360°, has a measuring head which determines the internal contour of the coil and, on the basis of a comparison of said contour with corresponding values of the reeling drum, the control device acts upon adjusting members for the vertical adjustment of the lifting carriage and/or the lateral offsetting of the coil resting on the lifting carriage and/or the relative rotation between the coil and the reeling drum.

In the positioning apparatus according to the invention the internal diameter of the coil is determined over the entire periphery, so that a comparison with the corresponding values for the reeling drum makes it possible to determine whether or not there is enough clearance between the internal diameter of the coil and the reeling drum over the entire periphery for the coil to be fitted on in a trouble-free manner. If overlappings are detected in the contours, the coil can be so positioned by the various adjusting movements that such overlappings are eliminated. The correction can be performed with one or more adjusting operations, in dependence on the nature of the contour and the overlapping.

If the coil is required to be positioned on the reeling drum in a predetermined axial position, this can readily be achieved by the feature of the invention that to determine the position of the coil on the lifting carriage and the width of the coil, the measuring head can be adjusted in the direction of the coil axis, and the control device determines the path travelled by the lifting carriage in dependence on said measured values. To preclude measuring errors in the determination of the axial position of the coil on the lifting carriage which may originate from an offsetting of the individual layers, the measuring head can be adapted to cover the end face of the coil and can be adjusted radially in relation to the coil. Any axial offsetting of the coil can be detected via the distances thus discovered and allowed for in determining the path travelled.

BRIEF DESCRIPTION OF THE DRAWINGS

The invention will now be described in greater detail with reference to drawings which illustrate an embodiment thereof and wherein.

DETAILED DESCRIPTION OF THE INVENTION

Figures 1, 2, 3, 4, 5, 6:
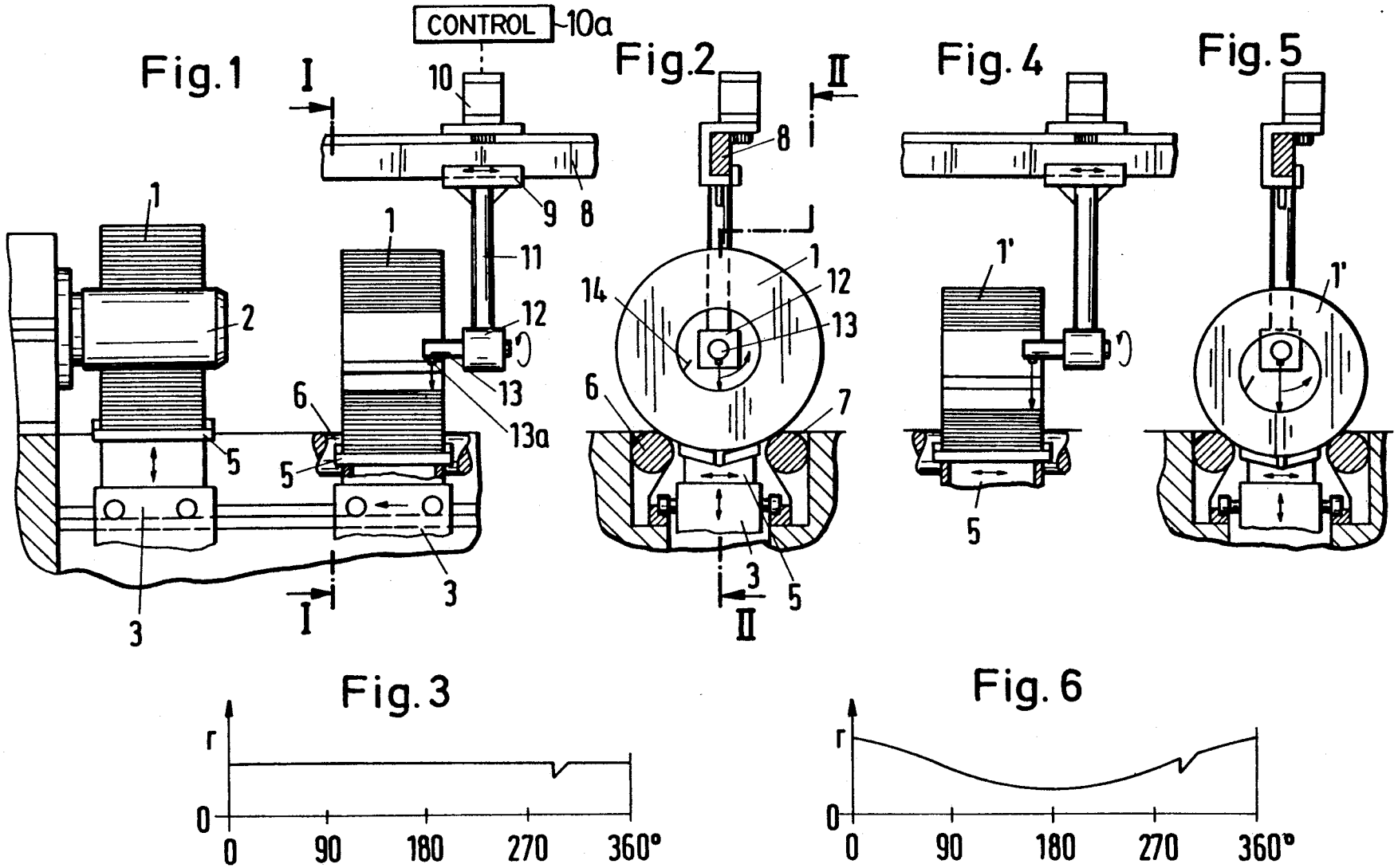
FIG. 1 is partly a side elevation of a positioning apparatus and partly a section thereof, taken along the line II—II in FIG. 2.
FIG. 2 is a front elevation of the positioning apparatus shown in FIG. 1 and a section thereof, taken along the line I—I in FIG. 1.
FIG. 3 is a graph of the measured value of the internal contour of the coil shown in FIGS. 1 and 2.
FIG. 4 shows the subject matter of FIG. 1 in a similar manner, with a coil of smaller diameter.
FIG. 5 shows the subject matter of FIG. 4, illustrated as in FIG. 2.
FIG. 6 is a graph of the measured value of the internal contour of the coil shown in FIG. 4, FIGS. 7 to 11 show the positioning apparatus illustrated in FIG. 1 with a vertically and laterally adjustable measuring head in different measuring positions.

To place a coil 1 on a reeling drum 2 a lifting carriage 3 is provided which can be moved on rails between a receiving position, shown on the right in FIG. 1, and a transfer position, shown on the left in FIG. 1. The lifting carriage 3 has a vertically and laterally adjustable channel-shaped supporting element 5 on which the coil 1 rests as it is moved.

In the receiving position of the lifting carriage 3, rollers 6, 7 disposed parallel with one another on both sides are provided as supporting and centering elements for the coil 1. When the supporting element 5 is lowered, the coil 1 can be rotated by means of the rollers 6, 7.

By the interplay between the vertically and laterally adjustable supporting element 5 and the rollers 6, 7, therefore, the coil 1 can be aligned in two axes and around the third axis.

A carriage 9 can be moved by a drive 10 over a rail 8. The carriage 9 bears on an arm 11 a measuring device 12 having a rotary measuring head 13. The measuring head 13 comprises a distance-sensing element 13*a*. As can be seen from FIG. 1, the measuring head 13 can be moved into the internal opening of the coil 1 by means of the driven carriage 9. The interior contour of the coil 1 can then be determined by the measuring head 13. At the same time, an inwardly projecting strip tongue 14 is also determined. FIG. 3 is a graph of the internal contour thus determined. The graph shows that the strip tongue 14 is situated at about 300°. Since otherwise the graph gives, a constant value, the internal contour is centered in relation to the measuring head and circular.

This measuring result is delivered to a control device 10*a*. For purposes of simplicity, control device 10*a* is shown only in FIG. 1 which compares it with the position of the reeling drum 2. Since the central opening of the coil 1 is already centered, all that is then required is vertical positioning and possibly a rotation of the coil in relation to a recess in the periphery of the reeling drum 2 for the strip tongue 14.

The embodiment illustrated in FIGS. 4 and 5 differs from that shown in FIGS. 1 and 2 merely by the feature that the coil 1' has a smaller external diameter. The result is that the internal diameter of the coil 1, lies eccentrically in relation to the firmly positioned measuring head 13. This is also indicated in the graph of FIG. 6. The eccentricity can be determined by comparing the measured values at 0°/360° and at 180°. Referring to FIG. 6, there is one maximum value at 0°/360° and one minimum value at 180°. Therefore, the eccentricity of the coil can be determined by comparing the maximum and minimum values. In dependence on this eccentricity the lifting carriage 3 can be raised until no maximum or minimum values are shown and the central opening lies centrally. When a measurement was again made, the graph of FIG. 3 was obtained.

Due to the vertical, lateral and rotary position of the coil 1, when the lifting carriage 3 is moved in the direction of the reeling drum 2 the coil 1 can be fitted on to the reeling drum 2 without collision. Further measurements must be carried out on the coil 1 to enable the coil also to be positioned axially on the reeling drum 2 as required.

Figures 7, 8, 9, 10, 11:
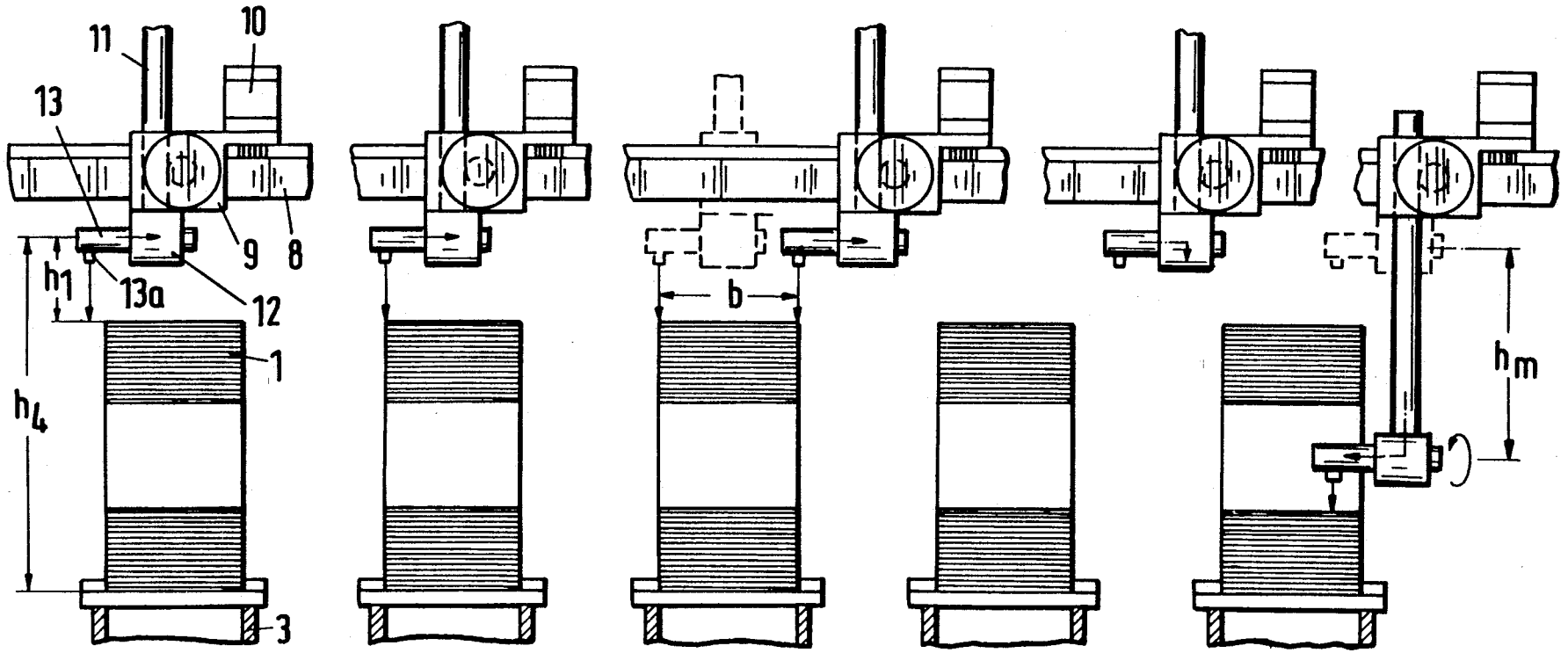
Figure 16A:
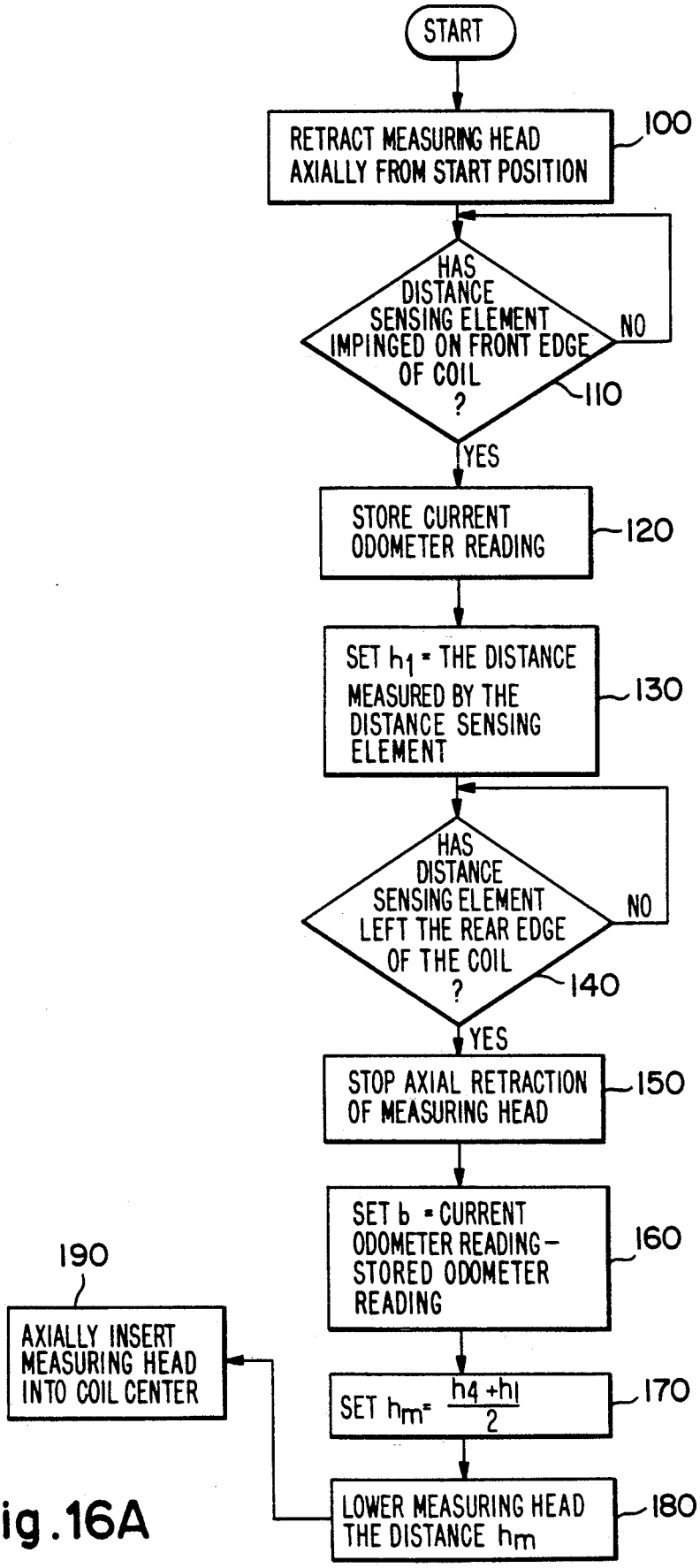
FIGS. 16A–16B show a flowchart giving details of the positioning movements.

FIGS. 7 to 11 show how the measuring device 12 with measuring head 13 can be moved vertically adjustably and axially over the coil 1, while FIG. 16A shows a flow chart of the steps carried out by control device 10*a*. The measuring head 13 is driven axially out of the starting position (FIG. 7 and box 100). During this movement an odometer integrated in the drive 10 delivers corresponding measured values of the distanced travelled to the control device 10*a*. The travel distance starts from the position shown in FIG. 7. A first signal is delivered when the distance-sensing element 13*a* impinges on the front edge of the coil 1 (position shown in FIG. 8 and box 110). The distance covered up to that point is retained (box 120), since it provides information concerning the position of the coil 1 on the lifting carriage 3. A second signal is delivered when the distance-sensing element 13*a* leaves the rear edge of the coil 1 (FIG. 9 and box 140). The value between these two signals is the coil width b (box 160). Via the two signals determined in this manner the control device can determine the path travelled by the coil 1 deposited in any axial position on the lifting carriage 3,,so that the coil is fitted on to the reeling drum 2 in a predetermined required axial position.

When the axial position of the coil 1 on the lifting carriage 3 and the width of the coil 1 have been determined, the measuring head 13 is moved into the position for determining the interior contour of the coil 1, as shown in FIG. 11 and box 180. The previously determined measured values are used for such positioning. Since the measuring head 13 has the distance-sensing element 13*a*, it also measures the distance $h_1$ from the vertex of the coil 1 (boxes 178, 180). Allowing for its known distance $h_4$ from the supporting element 5, the distance $h_m$ can be determined in the measuring device, to move the measuring head 13 into the central position, as shown in FIG. 11 (boxes 170, 180). This position agrees with that shown in FIG. 1.

Figure 14:
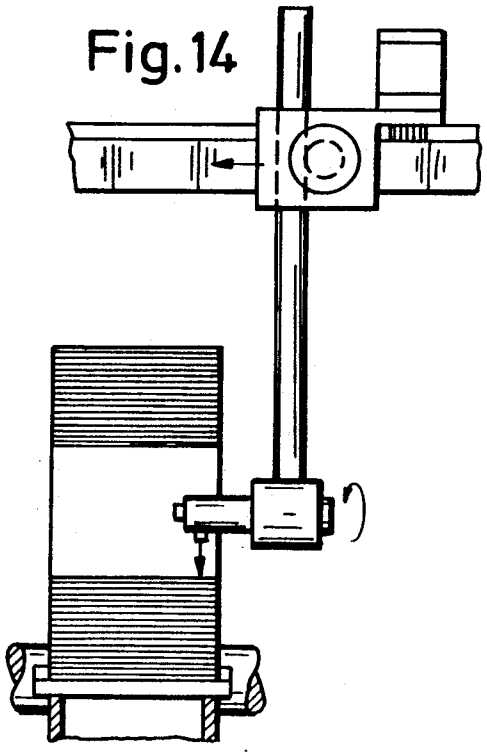
Figure 13:
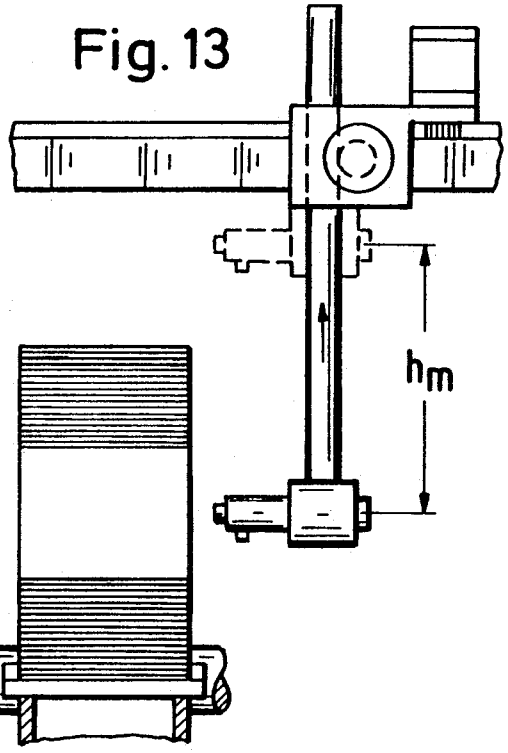
FIGS. 12 and 13 show the positioning apparatus illustrated in FIG. 1 with a vertically and laterally adjusting measuring head in a variant construction of FIGS. 1–11 in different measuring positions.
Figure 12:
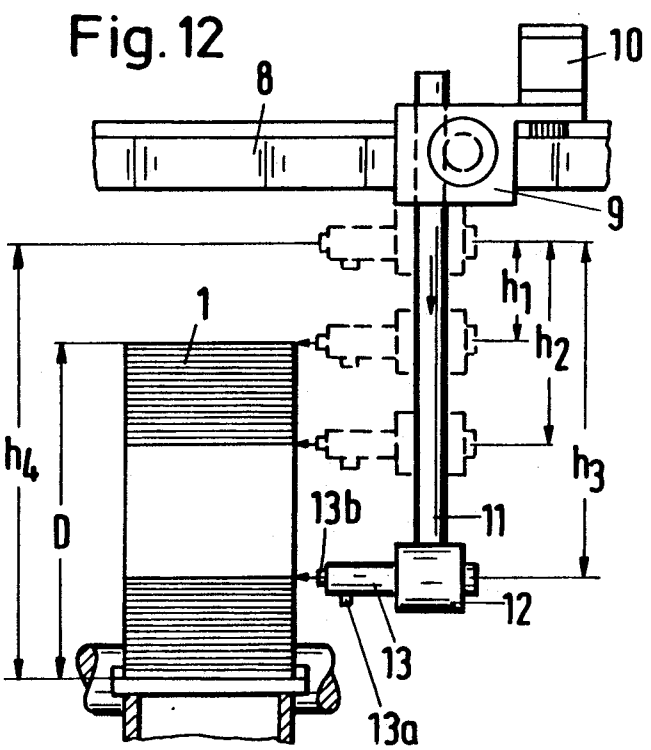
Figure 16B:
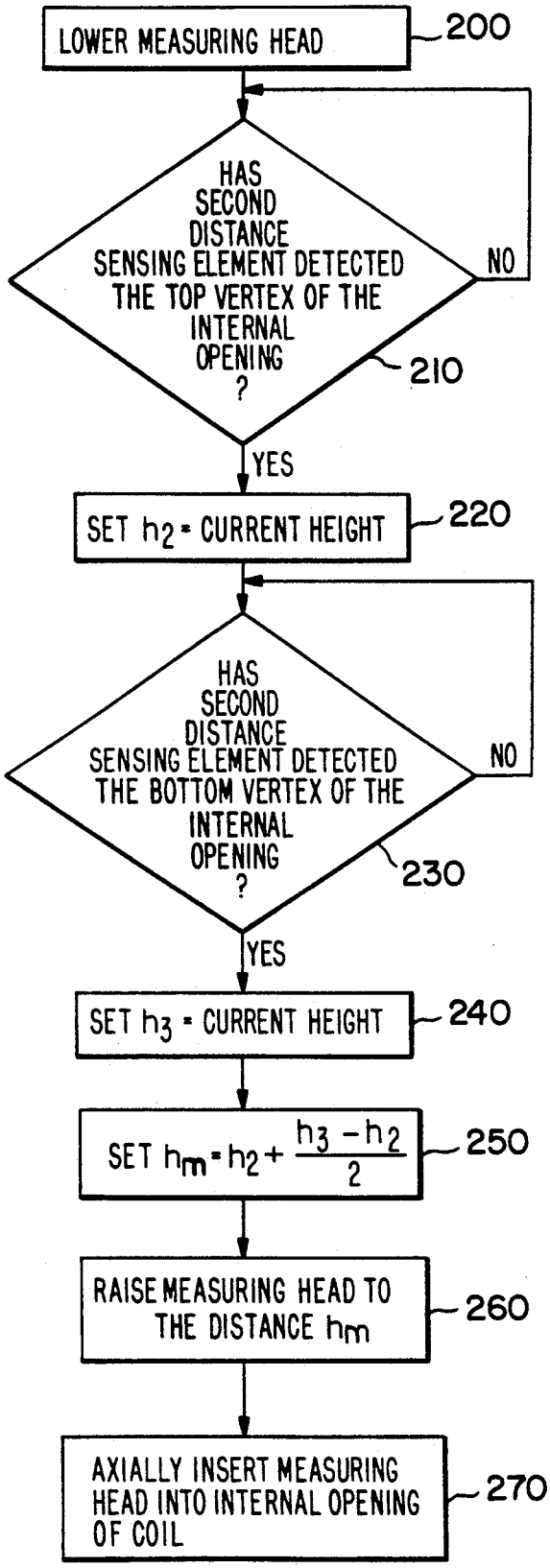

As illustrated in FIGS. 12 to 14, the measuring head 13 can be equipped with a further distance-sensing element 13*b* at its end. The distance-sensing element 13*b* measures the distance the end face of the coil 1. This measurement is used to determined possible axial offsettings of the individual layers of the coil 1, but it can also be used to determine the top and bottom vertices of the internal opening (See FIG. 16B for a flowchart of the steps to be carried out). The determination of a possible offsetting of the layers is important in connection with the determination of the width b, because if the outer layers are axially offset in relation to one another, the distance-sensing element 13*a* determining the width records not the actual width, but a larger width. This incorrect measuring result can be corrected by determining the end face, so that as a result the coil 1 can be correctly positioned axially on the reeling drum 2.

Figure 15:
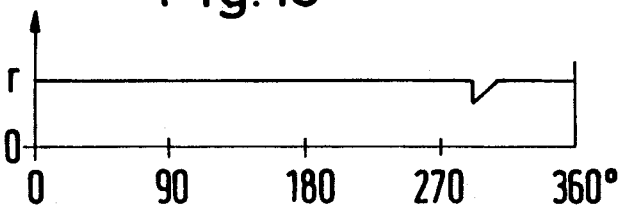
FIG. 15 is a graph, corresponding to FIG. 3, of the measured value of the internal contour of a coil.

However, the measured values $h_2$ and $h_3$ for the top and bottom vertices delivered by the end face distance-sensing element 13*a* (boxes 200–240 of FIG. 16B) enable the position value $h_m$ to be determined (box 250) also for the measuring head 13 to cover the internal contour, so that in the case of a circular contour which is not laterally offset the measuring device records a graph corresponding to FIG. 15.

We claim:

1. An apparatus for positioning a coil having a central opening onto a reeling drum, comprising a lifting carriage for lifting said coil onto said reeling drum, adjusting members which come into contact with sid coil resting on said lifting carriage for adjusting vertically and laterally the position of said coil and for rotating said coil relative to said reeling drum, a measuring device including a measuring head for determining the distance from said measuring head to points along 360° of the internal contour of the central opening of said coil resting on said lifting carriage and for producing measuring signals in response thereto, and control means connected to said lifting carriage, said adjusting members, and said measuring head for receiving said measuring signals from said measuring head and for causing said adjusting members and said lifting carriage to position said coil centrally relative to said reeling drum so that said coil can be lifted onto said reeling drum.

2. The positioning apparatus of claim 1 wherein sid measuring head is movable vertically and parallel to a coil axis, and wherein said control means includes means for determining a path travelled by said lifting carriage in dependence on signals received from said measuring head.

3. The positioning apparatus of claim 2 wherein said measuring head is radially adjustable relative to said coil, and said measuring head measures the size of an end face of said coil.

* * * * *